US008151484B2

(12) United States Patent
Hubner

(10) Patent No.: US 8,151,484 B2
(45) Date of Patent: Apr. 10, 2012

(54) THREE-PIECE FOOTWEAR

(75) Inventor: Paul Hubner, Burlington (CA)

(73) Assignee: Baffin Inc., Stoney Creek, Ontario (CA)

( * ) Notice: Subject to any disclaimer, the term of this patent is extended or adjusted under 35 U.S.C. 154(b) by 606 days.

(21) Appl. No.: 12/358,396

(22) Filed: Jan. 23, 2009

(65) Prior Publication Data

US 2009/0277041 A1 Nov. 12, 2009

(30) Foreign Application Priority Data

Mar. 27, 2008 (CA) ..... 2627262

(51) Int. Cl.
*A43B 1/10* (2006.01)
*A43B 13/18* (2006.01)

(52) U.S. Cl. ..... 36/4; 36/30 R; 12/142 E; 12/142 T; 12/146 BR

(58) Field of Classification Search ..... 36/4, 25 R, 36/30 R, 31, 77 R; 12/142 E, 142 T, 146 BR, 12/142 EV See application file for complete search history.

(56) References Cited

U.S. PATENT DOCUMENTS

| | | | | |
|---|---|---|---|---|
| 2,263,187 | A * | 11/1941 | Parkhurst | 36/34 A |
| 2,358,886 | A * | 9/1944 | Sullivan | 36/76 R |
| 5,720,117 | A * | 2/1998 | Toschi | 36/76 R |
| 6,237,249 | B1 * | 5/2001 | Aguerre | 36/11.5 |
| 6,855,281 | B2 * | 2/2005 | Gumringer et al. | 264/132 |
| 7,159,335 | B2 * | 1/2007 | Chen | 36/4 |
| 7,290,356 | B2 * | 11/2007 | Fuerst | 36/77 R |
| 7,614,165 | B2 * | 11/2009 | Curry | 36/101 |
| 2004/0020077 | A1 * | 2/2004 | Thomas et al. | 36/4 |
| 2007/0039210 | A1 * | 2/2007 | Clark et al. | 36/113 |

* cited by examiner

*Primary Examiner* — Ted Kavanaugh
(74) *Attorney, Agent, or Firm* — Patrick J. Hofbauer

(57) ABSTRACT

The invention comprises an item of footwear, comprising: a) an upper sole, shaped to receive a user's foot, and including a toe cap portion, a heel portion, and a sole portion, which is formed from a lightweight, thermally insulative plastics material; b) a lower sole, formed from a resilient plastics material, the lower sole attached to and at least partially covering the sole portion of the upper sole and operative to protect the upper sole from direct physical contact with the ground and to minimize wear on the upper sole; and c) an upper attached to the upper sole.

18 Claims, 7 Drawing Sheets

THREE-PIECE FOOTWEAR

FIELD OF THE INVENTION

The present invention relates to the field of footwear, and more particularly, to boots and shoes having soles produced by injection molding techniques.

BACKGROUND OF THE INVENTION

The manufacture of footwear, particularly more rugged footwear such as winter boots, work boots and athletic shoes, represents an ongoing balance between weight and durability. To reduce weight and to cut costs therein, it has become common to use lighter weight foamed or expanded plastics materials in the production of such footwear. For example, blown polyurethane has become commonly used as a midsole material for winter boots and athletic shoes. It is not only lighter than other plastics or synthetic rubbers (e.g. polyethylene) previously used, but exhibits good thermal insulative properties.

As a general rule, however, such lighter plastics materials are less durable, which makes them unsuitable for applications, such as lower soles, involving contact with the ground or other ambient surroundings. For children's footwear, this is not as significant a problem, as children are lighter, resulting in less wear of the item of footwear. Children's footwear also frequently require replacement of the footwear due to growth, which tends to be as rapid, if not more, than the need to replace the footwear due to wear. However, for adults, who are no longer growing, replacement is driven primarily by wear.

EVA (Ethylene Vinyl Acetate) is another inexpensive, lightweight plastics material with good insulation properties that is often used to form the insole or midsole of footwear, such as winter boots. However, EVA is also not very wear-resistant and, as such, has not been applied to forming portions of such footwear designed to be in contact with the ground, as the footwear will become unwearable due to abrasion quite rapidly. EVA has been used to make footwear for small children, as their light weight reduces the wear, and their rapid growth means the item of footwear will need to be replaced in a larger size before becoming too worn to wear.

It is an object of this invention to partially or completely fulfill one or more of the above-mentioned needs by providing an item of footwear that is not only cost-effective to mass manufacture, but which is also lightweight and resistant to undue wear through abrasion, whilst at the same time offering good thermal insulative properties.

SUMMARY OF THE INVENTION

The invention comprises an item of footwear having: a) an upper sole, shaped to receive a user's foot, and including a toe cap portion, a heel portion, and a sole portion, which is formed by injection molding of a lightweight, thermally insulative plastics material; b) a lower sole, formed by injection molding of a resilient plastics material, the lower sole being attached to and at least partially covering the sole portion of the upper sole and being operative to protect the upper sole from direct physical contact with the ground and to minimize wear on the upper sole; and c) an upper attached to the upper sole.

Preferably, the lower sole completely covers the sole portion of the upper sole and optionally, the toe cap portion and heel portion of the upper sole.

Preferably, the resilient plastics material from which the upper sole is molded is EVA (ethylene vinyl acetate).

It is thus an object of this invention to obviate or mitigate at least one of the above mentioned disadvantages of the prior art.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

A preferred embodiment of the invention will now be described in more detail, by way of example only, with reference to the accompanying drawings, in which like numbers refer to like elements, and wherein.

DETAILED DESCRIPTION OF THE PREFERRED EMBODIMENTS

Figure 1:
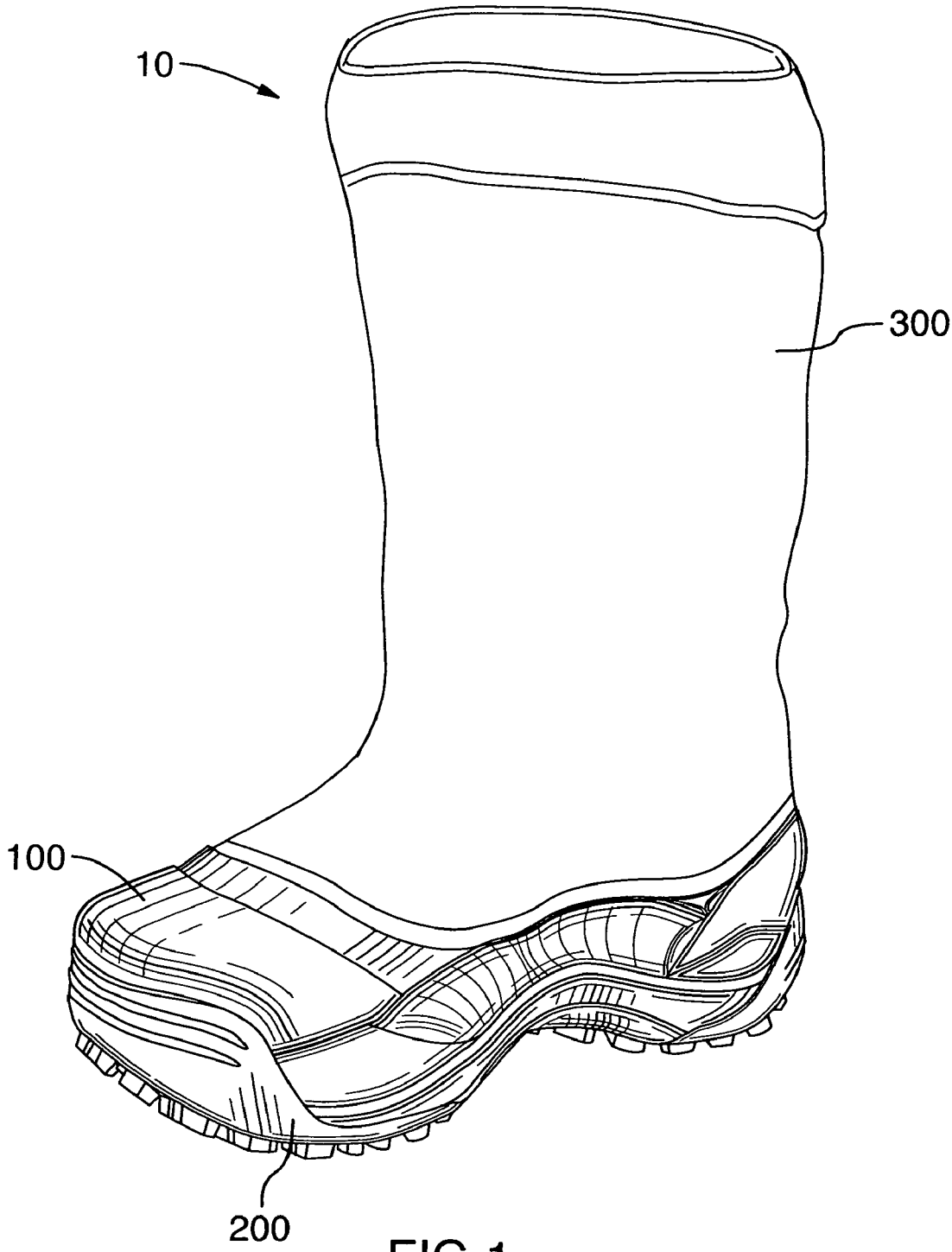
FIG. 1 is a front side perspective view of a preferred embodiment of a item of footwear, constructed according to the present invention.

Referring now to FIG. 1 of the drawings, there will be seen a preferred embodiment of footwear according to the present invention. The item of footwear illustrated herein is a winter boot 10, but the invention is not so restricted; rather other items of footwear, such as, for example, safety boots, safety shoes and athletic shoes are equally well within the scope of the present invention. The boot 10 is formed from three parts: an upper sole 100, a lower sole 200, and an upper 300.

Figure 2:
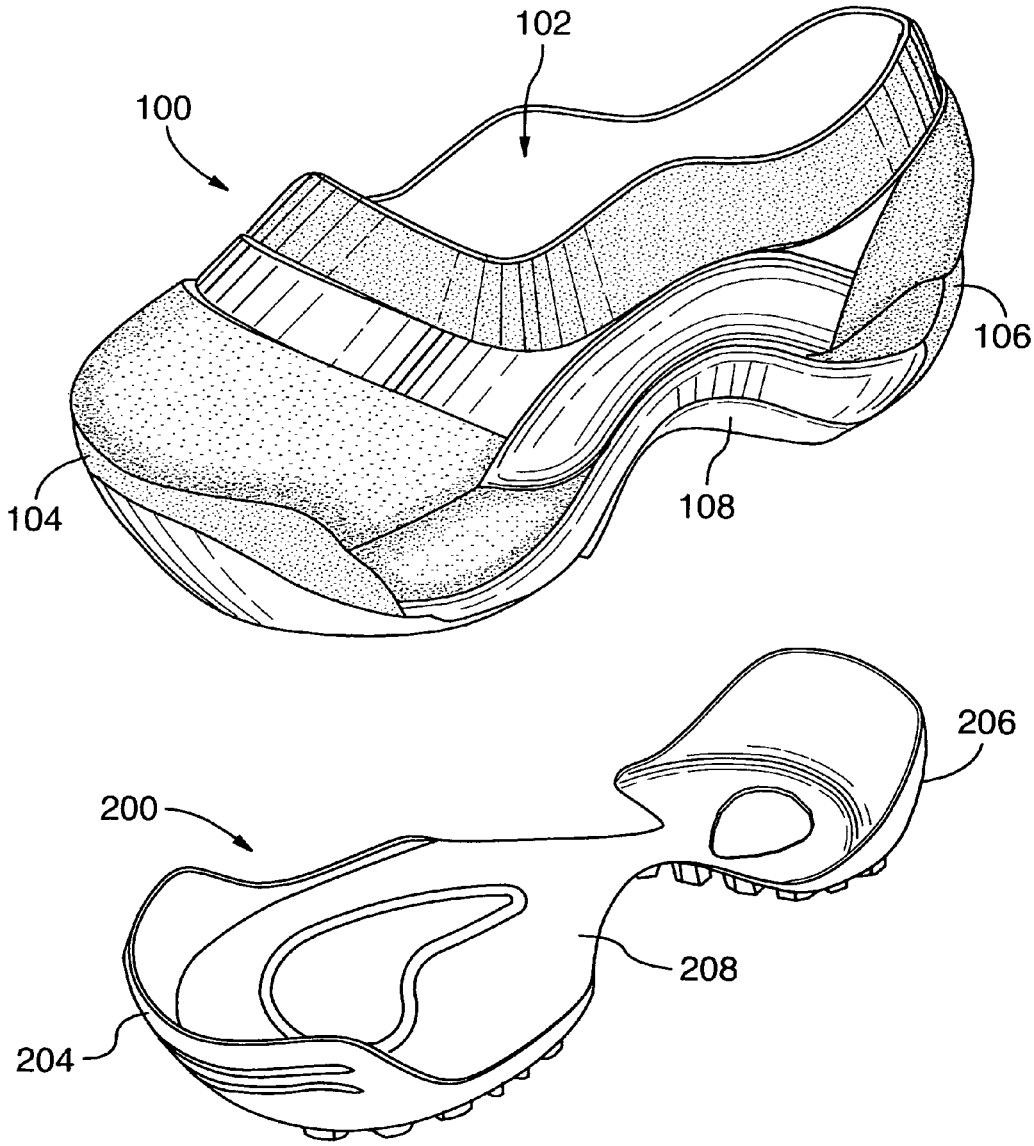
FIG. 2 is an exploded perspective view of the item of footwear of FIG. 1, with the upper removed for simplicity of illustration.

As shown in FIG. 2, the upper sole 100 is a molded piece of plastic or thermoplastic which is molded in a shape designed to receive a wearer's foot through an opening 102. The upper sole 100 conforms approximately to the shape of the wearer's foot in standard shoe sizes. The upper sole is comprised of a toe cap portion 104, a heel portion 106, and a sole portion 108.

Figure 6:
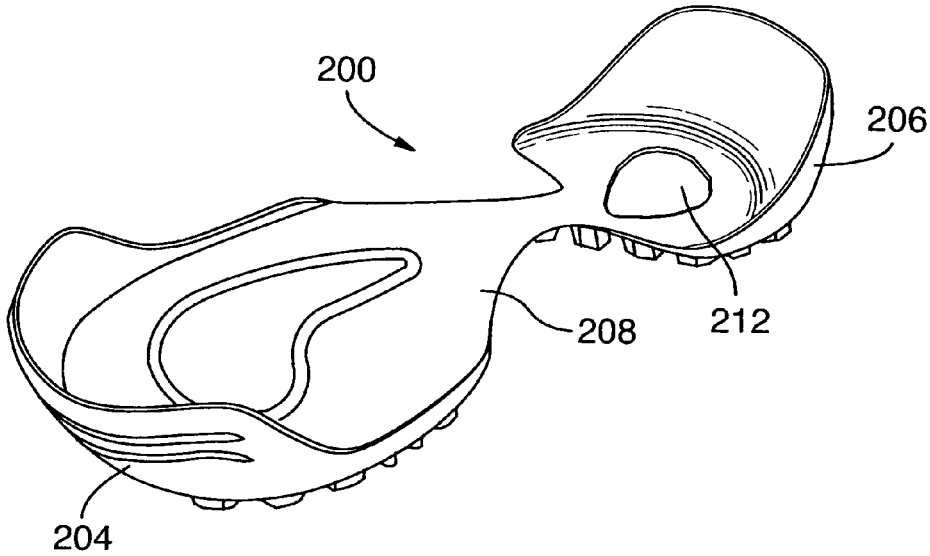
FIG. 6 is a front side perspective view of the lower sole of the item of footwear of FIG. 1.
Figure 7:
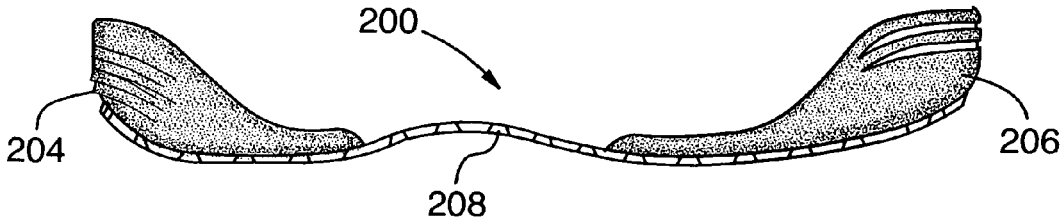
FIG. 7 is a side elevational view of the lower sole of FIG. 6.

Similarly, the lower sole 200, as shown in FIGS. 6 and 7, is a shaped or molded piece of resilient plastic, rubber or a similar material. Lower sole 200 is comprised of a sole portion 208, and optionally a toe cap portion 204 and a heel portion 206. The sole portion 208 of the lower sole 200 is shaped so as to adhere to and at least partially cover the sole portion 108 of upper sole 100. If present, the toe cap portion 204 and heel portion 206 adhere to and at least partially cover the corresponding toe cap portion 104 and heel portion 106. The bottom surface of the lower sole 200 is covered with a footwear tread pattern to provide traction in accordance with the purpose of the item of footwear 10.

The upper 300 (shown in FIG. 1) is attached to upper sole 100 along the edge of opening 102 by an adhesive or by thermal welding or a similar method that provides a water-tight seal.

Figure 3:
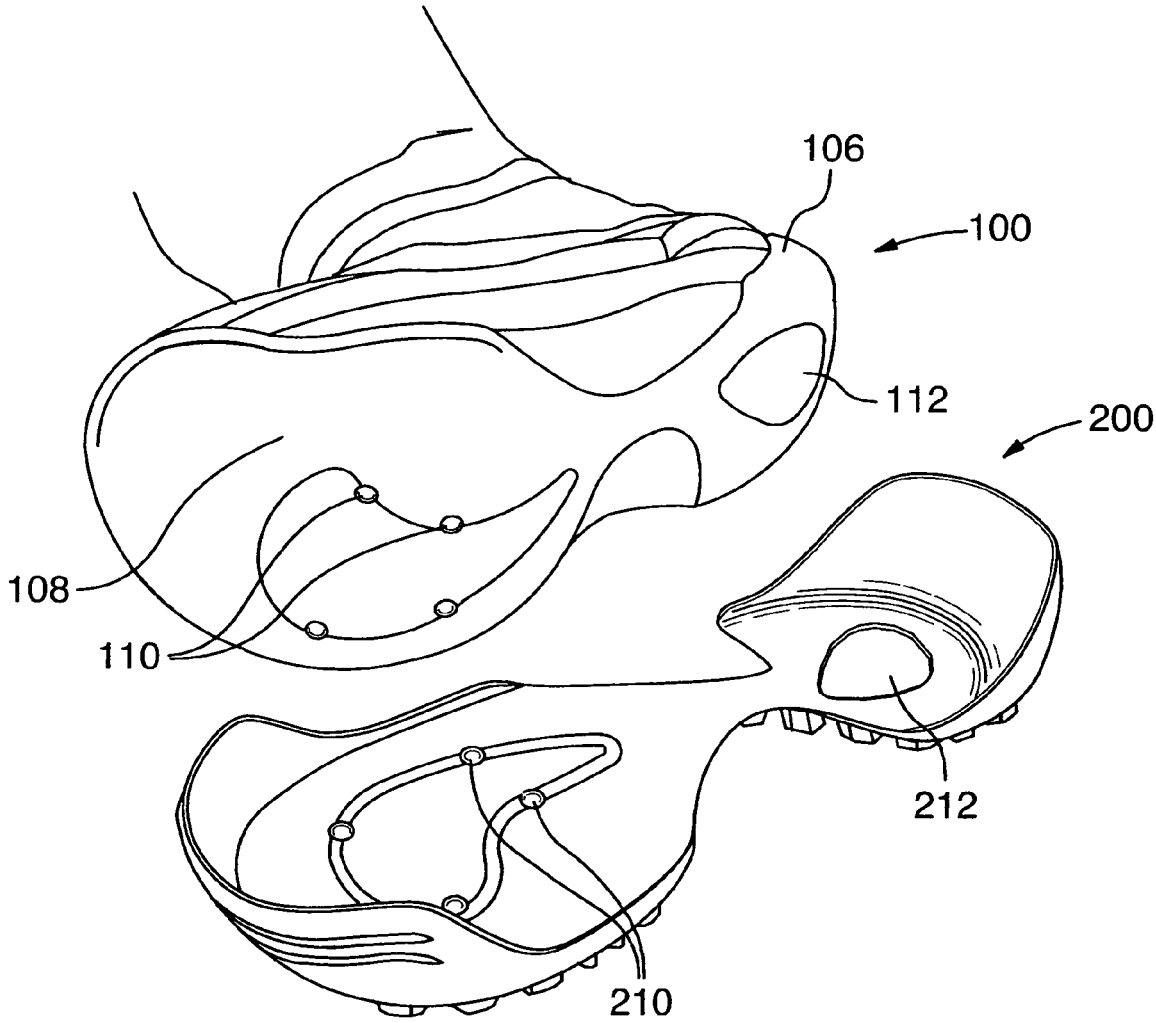
FIG. 3 is a partially exploded perspective view of the item of footwear of FIG. 1, with the upper and upper sole attached to one another and tilted to better illustrate the upper sole to lower sole attachment interface.
Figure 8:
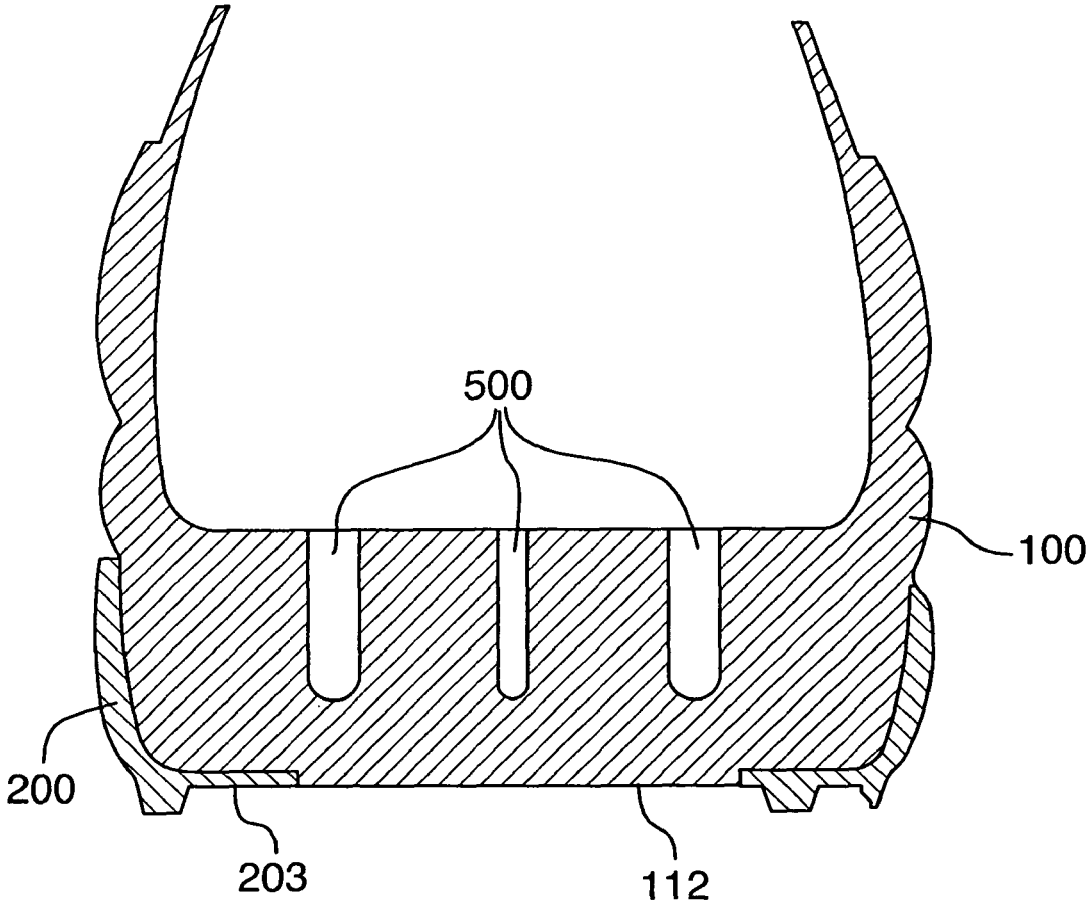
FIG. 8 is a cross-sectional view along line 8-8 of FIG. 4.

As shown best in FIG. 3, the upper sole 100 and lower sole 200 preferably have complimentary tabs and recesses, or similar interdigitating surface features 110 and 210, respectively, which are used to align their respective sole portions 108 and 208 for assembly. Other potential types of surface features include a lower surface extension 112 of the upper sole 100 which fits into a corresponding aperture 212 in the lower sole 200. Ideally, the lower surface extension 112 extends only as far as the bottom surface 203 of the lower sole 200, as shown in cross-section in FIGS. 5 and 8, so as to limit the ground contact and resulting wear of lower surface extension 112.

The lower sole 200 is adhered or thermally welded to the upper sole 100 and acts to protect the upper sole 100 from wear, allowing for a lightweight and less abrasion resistant material to be used in the upper sole construction without concerns about premature wear. Similarly, if present, the toe cap portion 204 and heel portion 206 of the lower sole 200 provide additional protection for their counterpart portions 104 and 106 of the upper sole 100, as the toe and heel portion of footwear can be subject to wear from surface contact in much the same manner as the sole portion.

Thus, the upper sole 100 is made from a lightweight material, preferably a plastic or thermoplastic, with good thermal insulative properties, and is also sufficiently rigid to be capable of maintaining the internal shape of the item of footwear. The resilience (wear resistance) of the upper sole material is not essential, as the sole portion 108 of the upper sole 100 is covered and protected by the resilient material of the sole portion 208 of the lower sole 200. A preferred material for forming the upper sole 100 is EVA (ethylene vinyl acetate).

The lower sole 200 is made of a resilient material to resist wear. Preferably, the resilient material is also flexible, to allow the lower sole 200 to more easily conform to the contours of the upper sole 100 during assembly, although a rigid material can alternatively be used. A preferred material for forming the lower sole 200 is natural rubber or synthetic rubber, such as, for example, and without limitation, polyvinyl chloride, polyurethane, polyethylene and nylon.

Figure 4:
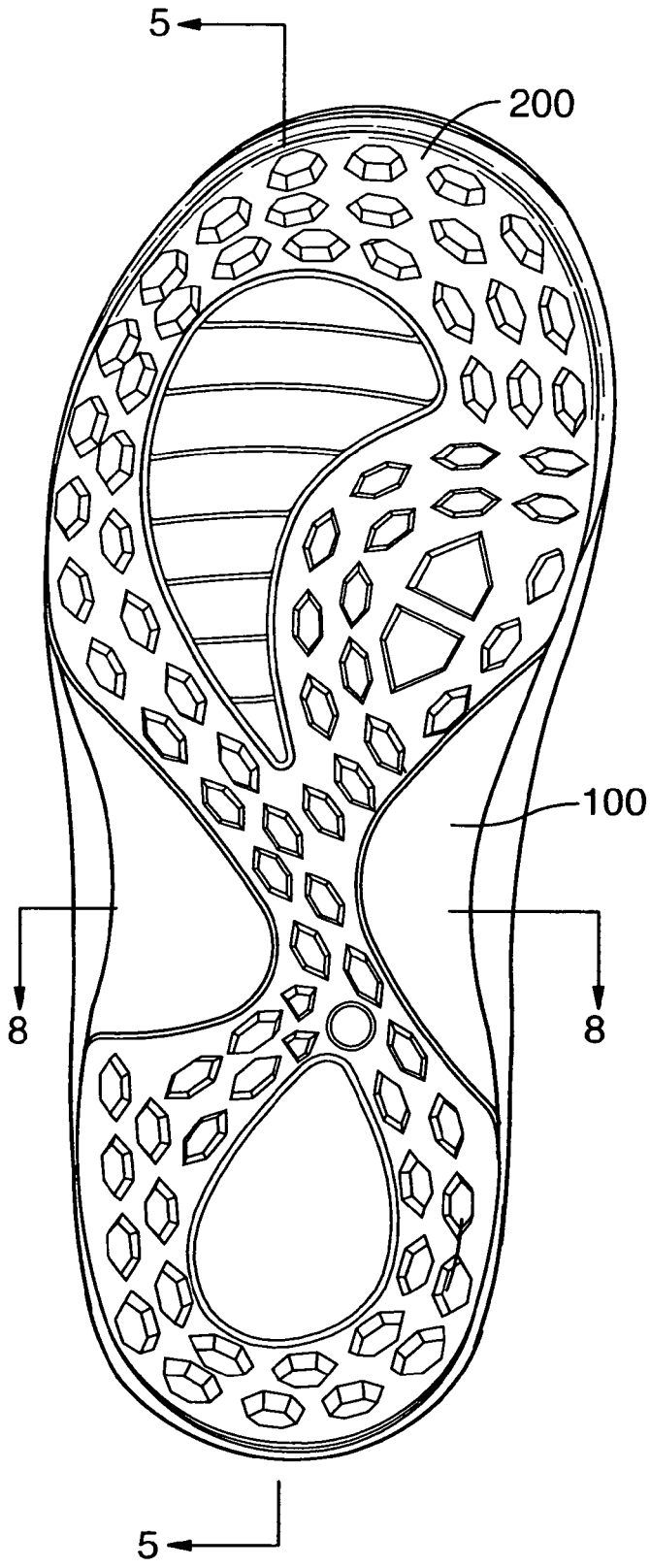
FIG. 4 is bottom plan view of the item of footwear of FIG. 1.
Figure 5:
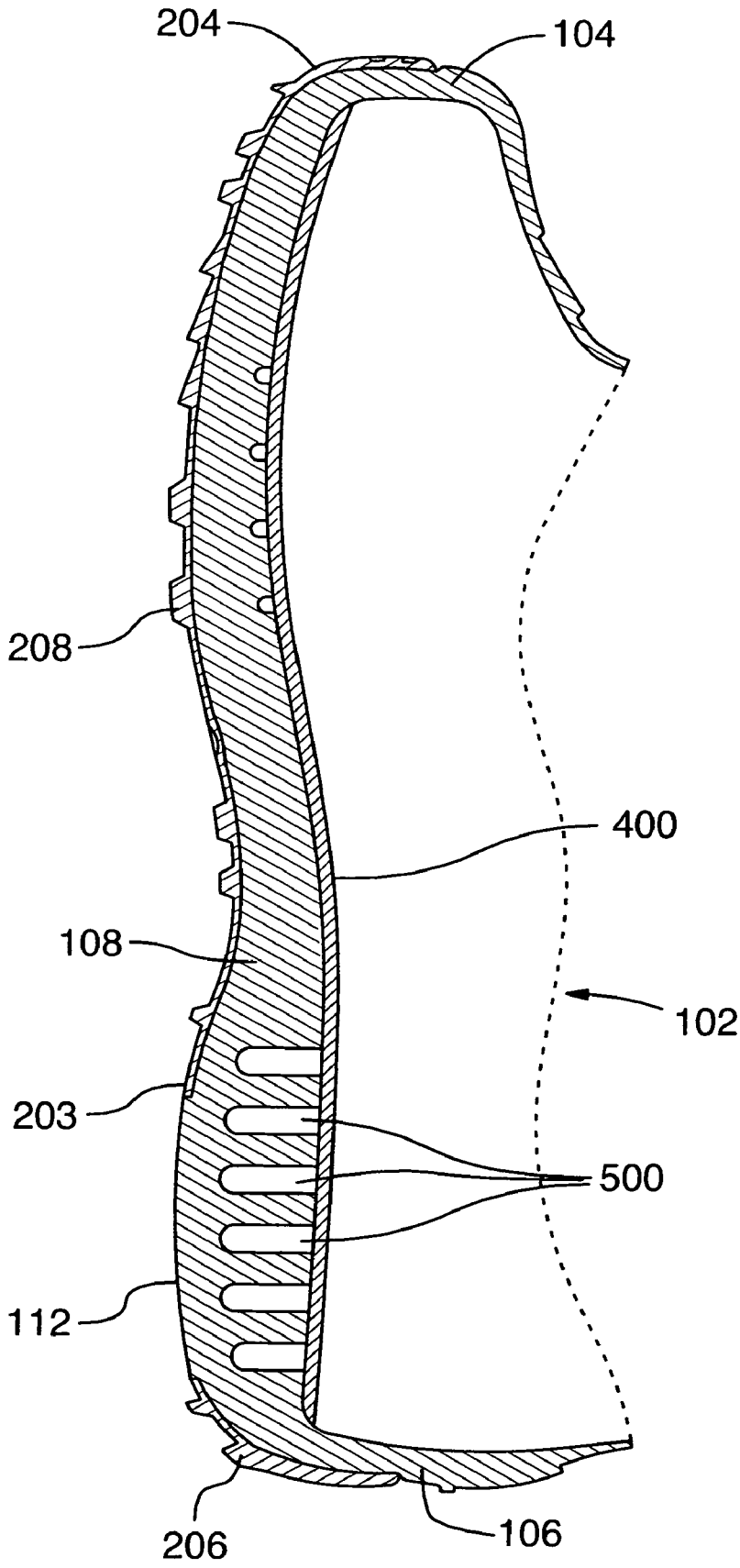
FIG. 5 is a cross-sectional view along line 5-5 of FIG. 4.

As best seen in FIG. 1 and in the longitudinal cross-section of FIG. 5, along sight line 5-5 of FIG. 4, the upper sole 100 makes up a significantly greater volume of the item of footwear 10 than does the lower sole 200, with the result that the selection of a less dense material for construction of the upper sole 100 will typically have a greater impact on the combined weight of the upper 100 and lower 200 sole assembly than would the selection of the material for construction of the lower sole 200. To further reduce weight, the lower sole 200 can include cutout areas, such as the aperture 212, which further acts to reduce the total weight of the item of footwear 10 while still ensuring that the upper sole 100 does not come in to regular contact with the ground. The cutouts can additionally reflect arch supports or decorative designs for the item of footwear 10. Upper sole 100 can additionally include an insole 400 for additional comfort and conformity to the user's foot.

Additionally, upper sole 100 can include cut-outs or channels 500, as shown in FIG. 5, which further can add engineered resiliency in supporting the user's foot and which can reduce the weight of upper sole 100 without unduly reducing structural stability. The exact number and location of such channels can vary significantly based on the material used for upper sole 100 and the intended application for the item of footwear 10.

To assemble the item of footwear 10, the upper sole 100 and lower sole 200 are formed as discussed above, preferably using known injection molding techniques. The lower sole 200 is then adhered to the upper sole 100 by contact along their respective sole portions 208, 108, as well as toe cap portions 204, 104 and heel portions 206, 106, if present. Preferably, the lower sole 200 is thermally welded to the upper sole 100, if their respective materials are compatible with the process. Alternatively, an adhesive substance can be used.

Once the upper sole 100 and lower sole 200 are bonded together, the upper 300 is attached to upper perimeter of the upper sole 100. Again, thermal welding is a preferred method of securing the upper 300 to the upper sole 100, if possible, with stitching and/or adhesives being viable alternatives.

As an alternative order of assembly, first, upper 300 can be attached to upper sole 100 as described above, and then lower sole 200 adhered to upper sole 100 as described above.

While the above invention has been presented in the context of a boot type of footwear, the structure and assembly method is equally applicable to other forms of footwear.

This concludes the description of a presently preferred embodiment of the invention. The foregoing description has been presented for the purpose of illustration and is not intended to be exhaustive or to limit the invention to the precise form disclosed. Many modifications and variations are possible in light of the above teaching and will be apparent to those skilled in the art. It is intended the scope of the invention be limited not by this description but by the claims that follow.

I claim:

1. An item of footwear comprising:

a) an upper sole, shaped to receive a user's foot, and including a top surface, a bottom surface, a toe cap portion, a heel portion, a sole portion, which is formed of a lightweight, thermally insulative plastics material, and a plurality of channels integrated into the upper sole between the top surface and the bottom surface;

b) a lower sole, formed of a resilient plastics material, the lower sole being attached to and at least partially covering the sole portion of the upper sole and being operative to protect the upper sole from direct physical contact with the ground and to minimize wear on the upper sole;

c) an upper attached to the upper sole; and d) wherein the upper sole and the lower sole respectively comprise complimentary tabs and recesses such that the engagement of each tab with a corresponding recess aligns the upper sole with the lower sole.

2. An item of footwear according to claim 1, wherein the lower sole completely covers the sole portion of the upper sole.

3. An item of footwear according to claim 1, wherein the lower sole additionally at least partially covers one of: the toe cap portion of the upper sole, the heel portion of the upper sole, and both the toe cap portion and the heel portion of the upper sole.

4. An item of footwear according to claim 1, wherein the resilient plastics material of the upper sole is made from EVA (ethylene vinyl acetate).

5. An item of footwear according to claim 1, wherein the lower sole is secured to the upper sole via thermal welding.

6. An item of footwear according claim 1, wherein the lower sole is secured to the upper sole via an adhesive.

7. An item of footwear according to claim 6, wherein the sole portion of the upper sole and the sole portion of the lower sole are modified with surface features operative to ensure correct alignment of the upper sole with the lower sole during assembly.

8. An item of footwear according to claim 7, wherein the surface features of the sole portion of the upper sole extend through corresponding apertures in the sole portion of the lower sole.

9. An item of footwear according to claim 1, further comprising an insole mounted atop said upper sole within said upper.

10. A method of assembling an item of footwear, comprising the steps of:

a) forming an upper sole from a lightweight, thermally insulative, plastics material, the upper sole being shaped to receive a user's foot and having a top surface, a bottom surface, a toe cap portion, a heel portion, a sole portion, and a plurality of channels integrated into the upper sole between the top surface and the bottom surface;

b) securing a lower sole formed of a resilient plastics material to the sole portion of the upper sole, the lower sole being formed to at least partially cover the sole portion of the upper sole and being operative to protect the upper sole from direct physical contact with the ground and to minimize wear on the upper sole;

c) securing an upper attached to the upper sole; and d) wherein the upper sole and the lower sole respectively comprise complimentary tabs and recesses such that the engagement of each tab with a corresponding recess aligns the upper sole with the lower sole.

11. A method according to claim 10, wherein the upper sole is made from EVA (ethylene vinyl acetate).

12. A method according to claim 10, wherein the lower sole completely covers the sole portion of the upper sole.

13. A method according to claim 10, wherein the lower sole additionally at least partially covers one of: the toe cap portion of the upper sole, the heel portion of the upper sole, and both the toe cap portion and the heel portion of the upper sole.

14. A method according to claim 10, furthering including a step of inserting an insole into the upper for mounting atop the upper sole.

15. A method according to claim 10, wherein the lower sole is integrally formed and comprises at least one aperture through which a portion of the upper sole extends.

16. A method according to claim 10, wherein at least one of the upper sole and lower sole are formed by injection molding.

17. An item of footwear according to claim 1, wherein the lower sole is integrally formed and comprises at least one aperture through which a portion of the upper sole extends.

18. An item of footwear according to claim 1, wherein at least one of the upper sole and lower sole are formed by injection molding.

* * * * *